US005788102A

United States Patent [19]

Hall et al.

[11] Patent Number: 5,788,102

[45] Date of Patent: Aug. 4, 1998

[54] FLIP TOP CARTON WITH POSITIVE SIDE LOCK

[75] Inventors: Richard A. Hall, Norristown; Frederick M. Allsop, Souderton, both of Pa.

[73] Assignee: Jefferson Smurfit Corporation, Clayton, Mo.

[21] Appl. No.: 697,078

[22] Filed: Aug. 19, 1996

[51] Int. Cl.[6] ..... B65D 5/54; B65D 5/56

[52] U.S. Cl. ..... 229/225; 220/416; 229/148

[58] Field of Search ..... 229/148, 225; 220/446, 418

[56] References Cited

U.S. PATENT DOCUMENTS

| | | | |
|---|---|---|---|
| 2,839,236 | 6/1958 | Dunning | 229/148 |
| 2,922,565 | 1/1960 | Roderick et al. | 229/148 |
| 3,404,829 | 10/1968 | Stone | 229/148 |
| 3,680,766 | 8/1972 | Collura et al. | 229/225 |
| 5,044,549 | 9/1991 | Beales | 229/148 |
| 5,203,495 | 4/1993 | Jorgensen-Beck et al. | 229/225 |
| 5,373,960 | 12/1994 | Gunn et al. | 229/225 |
| 5,439,168 | 8/1995 | Kim | 229/225 |
| 5,515,996 | 5/1996 | Stone | 220/416 |
| 5,518,172 | 5/1996 | Nanno | 229/148 |

*Primary Examiner*—Gary E. Elkins
*Attorney, Agent, or Firm*—Richard W. Carpenter

[57] ABSTRACT

A lined, flip top style, paperboard carton with an integral hinged cover, that includes a positive side lock arrangement between the carton body and cover on each side of the carton, wherein each of the minor upper inner closure flaps has a first section secured to the inner surface of the major upper outer closure flaps and a second section depending from the first section and having extending there through an opening adapted to receive and retain a tab, projecting outwardly from the upper edge of a carton liner secured to certain of the carton side walls, to maintain the cover in a closed position upon reclosure of the carton cover after initial opening.

20 Claims, 3 Drawing Sheets

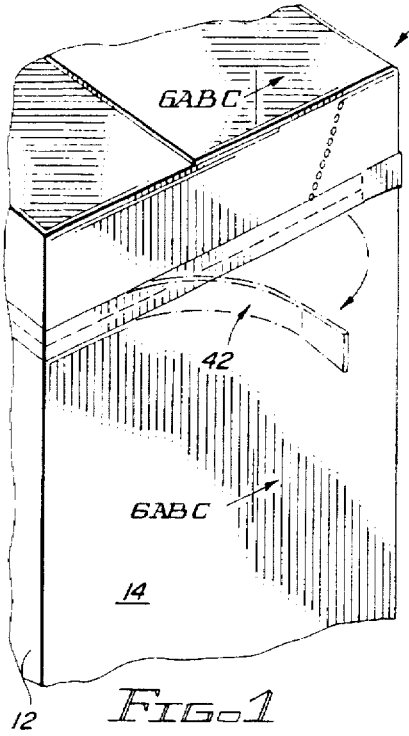
FIG. 1
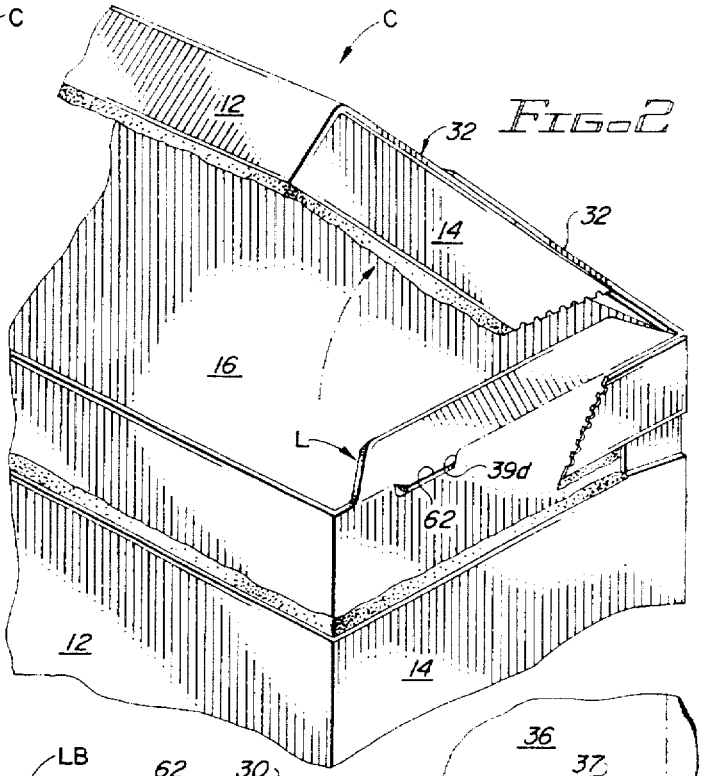
FIG. 2
FIG. 4
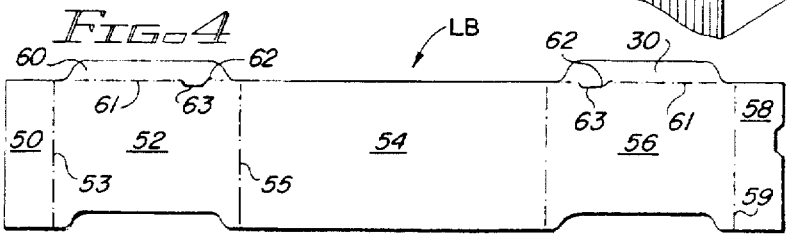
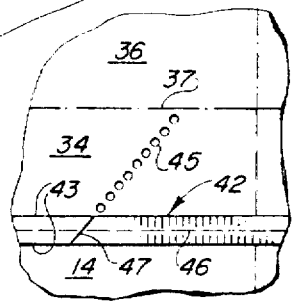
FIG. 5
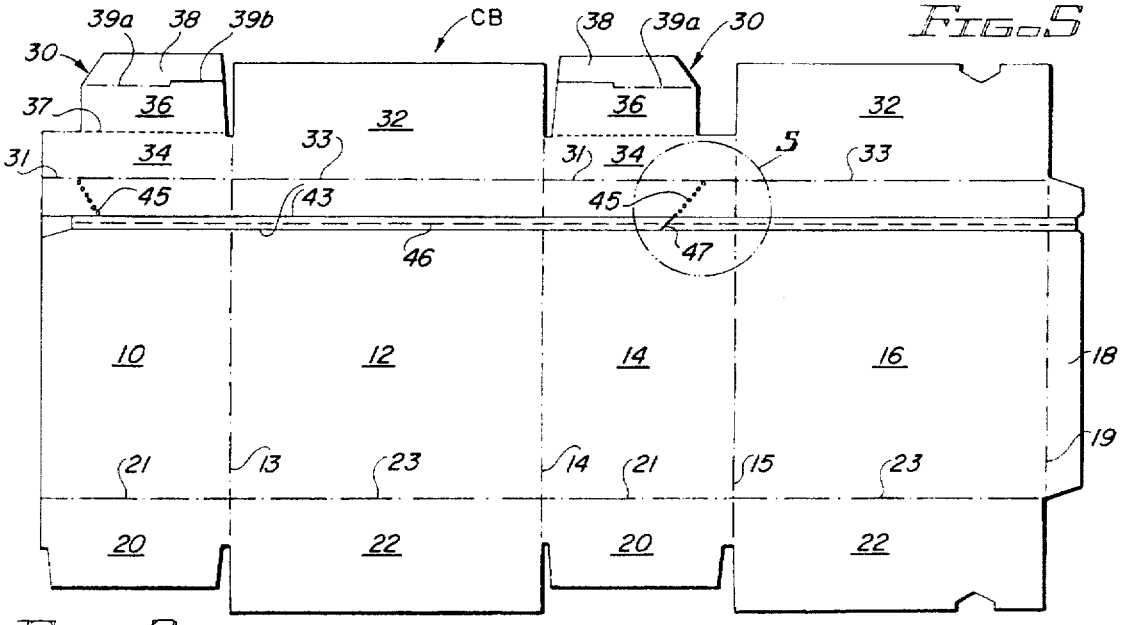
FIG. 3

FLIP TOP CARTON WITH POSITIVE SIDE LOCK

BACKGROUND OF THE INVENTION

1. Field of the Invention

This invention relates to paperboard folding cartons with reclosable hinged covers, and, more particularly, to a flip top style carton that includes positive side locks between the carton body and cover at both sides, upon reclosure of the carton cover.

2. Description of the Background Art

A background art search directed to the subject matter of this invention conducted in the United States Patent and Trademark Office disclosed the following United States Letters Patent:

| | | | |
|---|---|---|---|
| 3,684,159 | 3,910,486 | 4,216,898 | 5,040,722 |
| | 5,325,989 | 5,373,960 | |

None of the patents uncovered in the search discloses a lined, flip top style, paperboard carton with an integral hinged cover, that includes a positive side lock arrangement between the carton body and cover on each side of the carton, wherein each of the minor upper inner closure flaps has a first section secured to the inner surface of the major upper outer closure flaps and a second section depending from the first section and having extending there through an opening adapted to receive and retain a tab, projecting outwardly from the upper edge of a carton liner secured to certain of the carton side walls, to maintain the cover in a closed position upon reclosure of the carton cover after initial opening.

SUMMARY OF THE INVENTION

It is a primary object of the invention to provide a flip top style paperboard carton having a hinged cover with a positive locking arrangement on each side of the carton to maintain the cover in a closed position upon reclosure after initial opening.

Another object of the invention is the provision of a carton/cover side lock arrangement that is secure and will remain functional for numerous carton cover openings and reclosures.

Yet another object of the invention is to provide a carton/cover side lock arrangement wherein little if any changes or modifications are required to run the cartons over existing packaging line forming and filling equipment currently being used to form and fill similar cartons of conventional design.

A more specific object of the invention is the provision of a positive side lock arrangement between a carton body and cover on each side of the carton, wherein each of the minor upper inner closure flaps has a first section secured to the inner surface of the major upper outer closure flaps and a second section depending from the first section and having extending there through an opening adapted to receive and retain a tab, projecting outwardly from the upper edge of a carton liner secured to certain of the carton side walls, to retain the cover in a closed position upon reclosure of the carton cover after initial opening.

These and other objects of the invention will be apparent from an examination of the following description and drawings.

BRIEF DESCRIPTION OF THE DRAWINGS

FIG. 1 is an isometric view of an upper portion of a carton embodying features of the invention, with the hinged cover shown in a closed position;

FIG. 2 is a view similar to that of FIG. 1, but with the carton cover shown in an open position;

FIG. 3 is a plan view of a blank of foldable paperboard from which the carton illustrated in FIGS. 1, 2, 6A–6C may be formed;

FIG. 4 is a plan view of a blank of foldable paperboard from which the liner illustrated in FIG. 8 may be formed;

FIG. 5 is an enlarged view of a portion of the structure illustrated in FIG. 3.

It will be understood that, for purposes of clarity, certain elements may have been omitted from certain views where they are believed to be illustrated to better advantage in other views.

DESCRIPTION OF THE PREFERRED EMBODIMENT

Figure 4A:
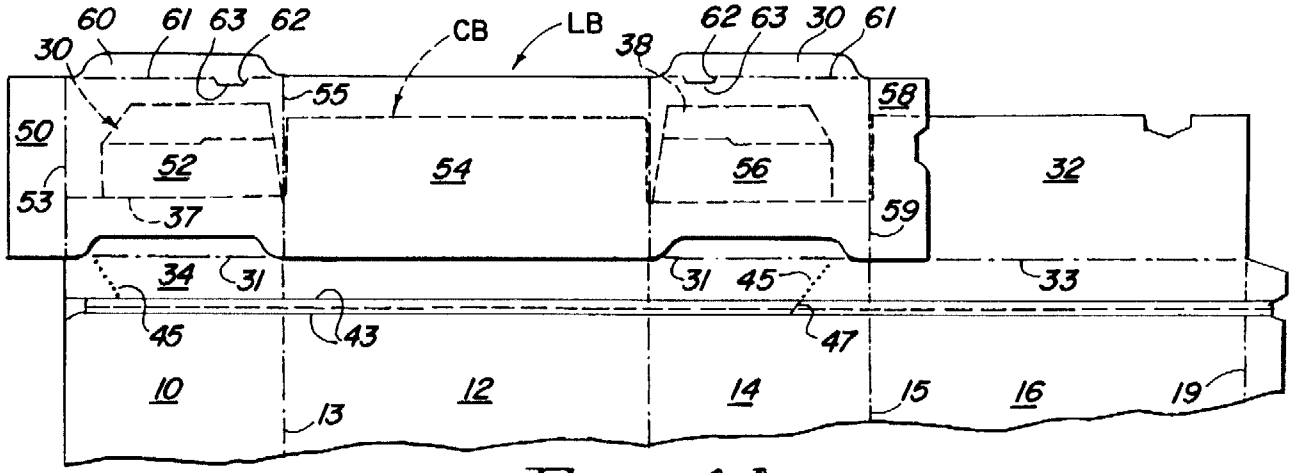
FIG. 4A is a view similar to that of FIG. 3, but with the liner blank of FIG. 4 shown in position against the carton blank.

Referring now to the drawings for a better understanding of the invention, it will be seen that the flip top carton body with hinged cover, indicated generally at C in FIG. 1, may be formed from the carton blank CB, illustrated in FIG. 3; while the liner, indicated generally at L in FIG. 2, may be formed from the liner blank LB, shown in FIG. 4.

The relationship of the liner blank LB to the carton blank CB is illustrated in FIG. 3A.

As best seen in FIG. 3 the carton body C includes a first minor side wall panel 10, a first major side wall panel 12, a second minor side wall panel 14 a second major side wall panel 16, and a glue flap 18 which are foldably joined to each other along parallel fold lines 13, 15, 17, and 19, respectively, to form a collapsible tubular structure open at the ends.

Closure of the lower end is accomplished by pairs of opposed lower minor inner closure flaps 20 and lower major outer closure flaps 22, which are foldably joined to lower end edges of the minor and major side wall panels along fold lines 21 and 23, respectively, and which are adhesively secured to each other in overlapped relation.

In a similar manner the upper end of the carton is closed by pairs of opposed upper minor inner closure flaps 30 and upper major outer closure flaps 32, which are foldably joined to upper end edges of the minor and major side wall panels along fold lines 31 and 33, respectively, and which are adhesively secured to each other in overlapped relation.

As best seen in FIGS. 3 and 6A–6C, each upper minor inner closure flap 33 includes a first section 34, having an outer edge foldably joined on the previously mentioned fold line 31 to the upper edge of the related minor side wall panel and folded inwardly and adhesively secured to the inner surfaces of upper major outer closure flaps 32; a second section 36, having an inner edge foldably joined along a fold line 37 to an inner edge of first section 34 and folded outwardly and adhesively secured to the inner surface of second section 36; and a third section 38, having an upper edge foldably joined along a fold line **39*a* to an outer edge of second section 36** and folded downwardly to lie next to the inner surface of the adjacent minor side wall panel.

Third section 38 has, extending transversely from one end of fold line 39*a* to the side edge of third section 38, a cut 39*b*, the major portion of which is spaced a short distance from and extends parallel to fold line 39*a* and, which forms in third section 38, a tab receiving opening 39*c* adapted to receive a lock tab 62, as hereinafter described.

As best seen in FIGS. 2 and 3, carton C includes a reclosable, flip top style, hinged cover 40 which is formed by a detachable tear strip 42 defined by a pair of weakened cut lines 43, in the outer surfaces of the front major side wall panel 12 and the minor side wall panels 10 and 14, and a narrow strip of plastic tape 46 adhesively secured to the panels between the cut lines 43.

As best seen in FIG. 2, the minor side wall panels 10 and 14 are provided with weakened lines of tear 45 that extend diagonally downwardly and forwardly from the upper edges of the minor side wall panels to the ends of tear strip 42.

Since it is more practical to lay the plastic tape across the entire width of the carton blank, the tape may be cut, as shown at 47, so that only the desired part of the tape is functional.

In order to open the carton, one end of the detachable tear strip 42 is grasped and the tear strip removed. At the same time the front and rear portions of each minor side wall panel above the tear strip are separated to form a reclosable flip top style cover.

Turning now to FIGS. 3A and 4, it will be seen that liner L includes a first glue flap 50, a first minor panel 52, a major panel 54, a second minor panel 56, and a second glue flap 58 which are foldably joined to each other along parallel fold lines 53, 55, 57, and 59, respectively. Each minor panel has an upper section 60 foldably joined to its upper edge along a fold line 61.

Intermediate its ends fold line 61 is interrupted by an elongated C-shaped cut 63 that extends into the related minor panel to form therein an elongated lock tab 62 that is arranged and disposed to extend outwardly from section 60 when section 60 is folded inwardly from its related minor panel.

Figures 6A, 6B, 6C, 7, 8, 9, 10, 11:
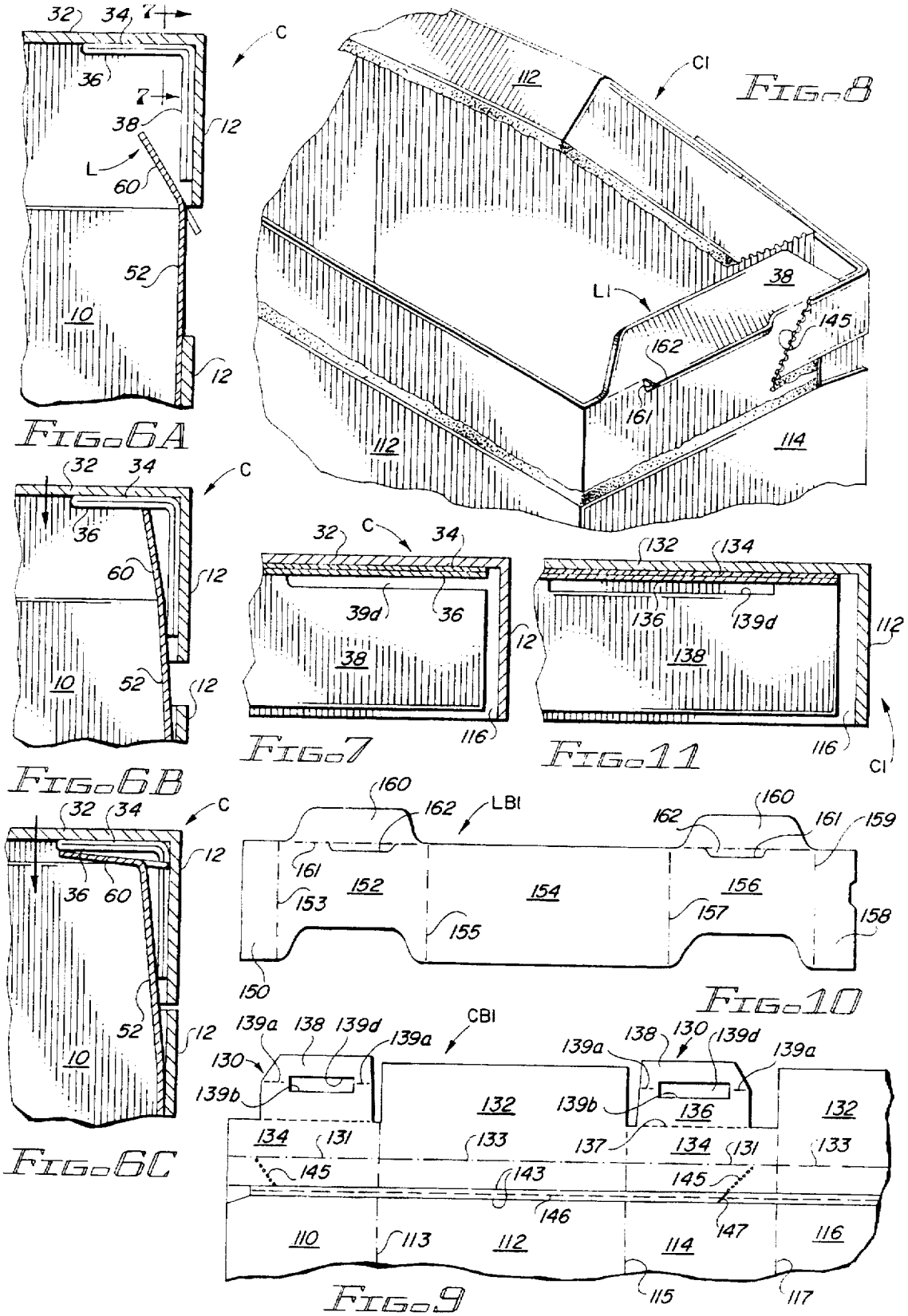
FIGS. 6A–6C are fragmentary vertical sectional views taken on line 6ABC—6ABC of FIG. 1, showing the cover before being opened and after reclosure.
FIG. 7 is a fragmentary sectional view taken on line 7-7 of FIG. 6A.
FIGS. 8, 9, 10, 10A, and 11 are view similar to those of FIGS. 1, 3, 4, 4A, and 7, respectively.

The function of lock tab is to engage related opening 39*c*, upon reclosure of the cover, to positively lock the cover in a closed position, as illustrated in FIGS. 6A–6C.

Turning now to FIGS. 8–11 of the drawings, it will be seen that a slightly modified form of the invention is illustrated. In this second described embodiment of the invention, elements corresponding to elements of the previously described embodiment have been identified by the same or related numerals.

All of the elements of the second embodiment are the same as those of the first embodiment except for the upper minor inner closure flaps and the related liner minor panel upper sections and lock tabs.

As best seen in FIG. 9, each upper minor inner closure flap 130 includes a first section 134, having an outer edge foldably joined on fold line 131 to the upper edge of the related minor side wall panel and folded inwardly and adhesively secured to the inner surfaces of upper major outer closure flaps 132; a second section 136, having an inner edge foldably joined along a fold line 137 to an inner edge of first section 134 and folded outwardly and adhesively secured to the inner surface of second section 136; and a third section 138, having an upper edge foldably joined along a fold line 139*a* to an outer edge of second section 136 and folded downwardly to lie next to the inner surface of the adjacent minor side wall panel.

Third section 138 has extending therethrough a generally rectangular lock tab receiving opening 139*c* located intermediate the side edges of flap 132 and defined by a cut line 139*b*, portions of which lie on both sides of fold line 139*a*. The purpose of opening 139*c* is to receive a lock tab.

As best seen in FIGS. 8 and 10, carton C1, which is formed from blank CB1, includes a reclosable, flip top style, hinged cover 140 which is formed in exactly the same manner as the cover 40 of the previously described embodiment.

Figure 10A:
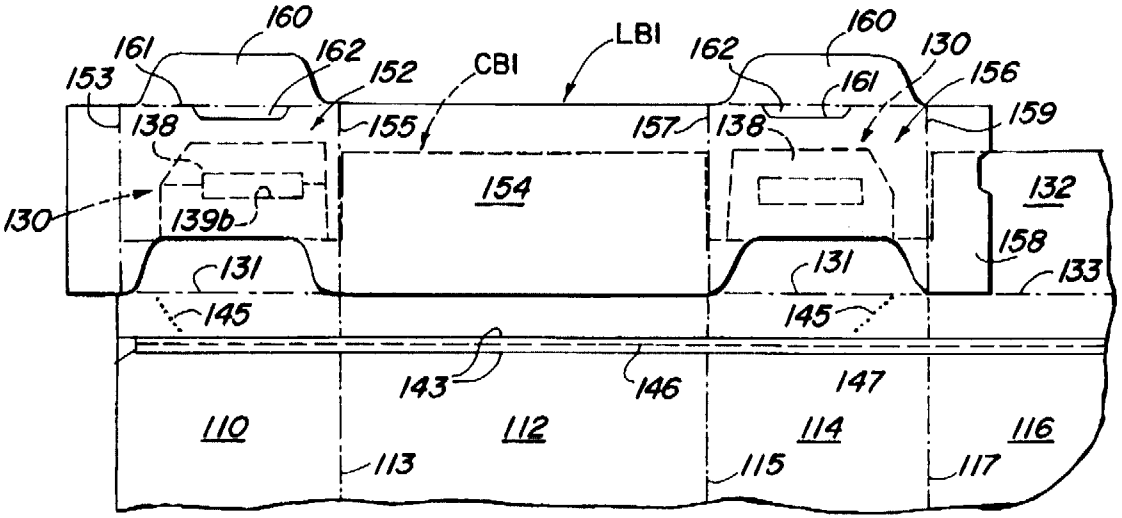

Turning now to FIGS. 9 and 10A, it will be seen that liner L1, formed from blank LB, includes a first glue flap 150, a first minor panel 152, a major panel 154, a second minor panel 156, and a second glue flap 158 which are foldably joined to each other along parallel fold lines 153, 155, 157, and 159, respectively. Each minor panel has an upper section 160 foldably joined to its upper edge along a fold line 161.

Intermediate its ends fold line 161 is interrupted by an elongated C-shaped cut 163 that extends into the related minor panel to form therein an elongated lock tab 162 that is arranged and disposed to extend outwardly from section 160 when section 160 is folded inwardly from its related minor panel.

The function of the lock tab is to engage related opening 139*c*, upon reclosure of the cover, to lock the cover in a closed position, as shown in FIGS. 6A–6C for the prior embodiment.

Thus, it should be understood that each embodiment of the invention provides a flip top carton cover with a positive side lock arrangement that is secure and will remain functional for numerous carton cover openings and reclosures.

What is claimed is:

1. A lined carton with an integral, reclosable, hinged, flip top cover having a positive side lock arrangement, said carton being formed from a pair of separate blanks of foldable sheet material, such as paperboard, and comprising:

(a) a body including a pair of opposed major front and rear side wall panels and a pair of opposed minor side wall panels foldably joined to each other to form a tubular structure open at its upper and lower ends;

(b) pairs of opposed lower outer and inner closure flaps foldably joined to lower ends of said major and minor side wall panels and secured to each other in overlapped relation to close the lower end of the carton;

(c) pairs of opposed upper outer and inner closure flaps foldably joined to upper ends of said major and minor side wall panels and secured to each other in overlapped relation to close the upper end of the carton;

(d) each of said upper inner closure flaps including:

(i) a first section foldably joined, on a first fold line, to an upper end edge of a related one of said minor side wall panels, folded inwardly, and adhesively secured to a lower surface of at least one of said upper outer closure flaps;

(ii) a second section foldably joined, on a second fold line, to an inner edge of said first section, folded outwardly, and adhesively secured to a lower surface of said first section;

(iii) a third section foldably joined, on a third fold line, to an outer edge of said second section, extending downwardly therefrom adjacent a related one of said minor side wall panels, and presenting a horizontally extending lock tab receiving opening located adjacent said second section;

(e) upper portions of said front side wall panel and said minor side wall panels being detachable from remaining portions to form, with said upper closure flaps, a cover hinged to the upper edge of said rear side wall panel;

(f) said liner including:

(i) a pair of vertical panels positioned adjacent inner surfaces of and parallel to said carton minor side walls;

(ii) each of said vertical panels having, foldably joined to an upper edge thereof, a generally horizontal panel extending inwardly therefrom with a lock tab projecting outwardly therefrom for engagement with said lock tab receiving opening to retain said cover in a closed position upon reclosure of the cover after initial opening of said cover.

2. A carton according to claim 1, wherein each of said tab forming openings is formed by a slit in said third section that is spaced a short distance from and extends parallel to said third fold line.

3. A carton according to claim 1, wherein each of said lock tab receiving openings is a hole that is defined by parallel first edges, located on both sides of said third fold line, and second edges connecting corresponding ends of said first cut lines to each other.

4. A carton according to claim 1, wherein each of said lock tab receiving openings is located adjacent one end of said third fold line.

5. A carton according to claim 1, wherein each of said lock tab receiving openings is located intermediate and is spaced from opposite ends of said third fold line.

6. A carton according to claim 1, including a detachable tear strip extending across portions of said minor side wall panels and said major front side wall panel, and wherein said minor side wall panels have weakened lines of tear extending down and forwardly from upper edges of said minor side wall panels to adjacent ends of said tear strip, to separate an upper portion of said carton from a lower portion thereof and thereby form a reclosable hinged cover joined to an upper edge of said major rear side wall panel.

7. A lined carton with an integral, reclosable, hinged, flip top cover having a positive side lock arrangement, said carton being formed from a pair of separate blanks of foldable sheet material, such as paperboard, and comprising:

(a) a body including a pair of opposed major front and rear side wall panels and a pair of opposed minor side wall panels foldably joined to each other to form a tubular structure open at its upper and lower ends;

(b) pairs of opposed lower outer and inner closure flaps foldably joined to lower ends of said major and minor side wall panels and secured to each other in overlapped relation to close the lower end of the carton;

(c) pairs of opposed upper outer and inner closure flaps foldably joined to upper ends of said major and minor side wall panels and secured to each other in overlapped relation to close the upper end of the carton;

(d) each of said upper inner closure flaps including:

(i) a horizontal section foldably joined, on one fold line, to an upper end edge of a related one of said minor side wall panels, folded inwardly, and adhesively secured to a lower surface of at least one of said upper outer closure flaps;

(ii) a vertical section joined, on another fold line, to and extending downwardly from said horizontal section adjacent a related one of said minor side wall panels, and having a lock tab receiving opening located adjacent said other fold line;

(e) upper portions of said front side wall panel and said minor side wall panels being detachable from remaining portions to form, with said upper closure flaps, a cover hinged to an upper edge of said rear side wall panel;

(f) said liner including:

(i) a pair of vertical panels positioned adjacent inner surfaces of and parallel to said carton minor side walls;

(ii) each of said vertical panels having, adjacent its upper edge, a lock tab projecting outwardly therefrom for engagement with said lock tab receiving opening to retain said cover in a closed position upon reclosure of the cover after initial opening of said cover.

8. A carton according to claim 7, wherein each of said lock tab forming openings is formed by a slit in said vertical section that is spaced a short distance from and extends parallel to said second fold line.

9. A carton according to claim 7, wherein each of said lock tab receiving openings is a hole that is defined by parallel first edges, located on both sides of said second fold line, and second edges connecting corresponding ends of said first cut lines to each other.

10. A carton according to claim 7, wherein each of said lock tab receiving openings is located adjacent one end of said second fold line.

11. A carton according to claim 7, wherein each of said lock tab receiving openings is located intermediate and is spaced from opposite ends of said second fold line.

12. A carton according to claim 7, including a detachable tear strip extending across portions of said minor side wall panels and said major front side wall panel, and wherein said minor side wall panels have weakened lines of tear extending down and forwardly from upper edges of said minor side wall panels to adjacent ends of said tear strip, to separate an upper portion of said carton from a lower portion thereof and thereby form a hinged cover joined to an upper edge of said major rear side wall panel.

13. A carton according to claim 7, wherein said carton liner includes a first glue flap, a first minor panel, a major panel, a second minor panel, and a second glue flap foldably joined to each other along parallel fold lines, and wherein said major panel and said glue flaps are adhesively secured to upper portions of adjacent inner surfaces of said carton body major front and rear side wall panels, respectively, and wherein said liner minor panels are free from attachment to said carton body.

14. A unitary blank of foldable sheet material, such as paperboard, for use in making a carton with an integral, reclosable, hinged, flip top cover having a positive side lock arrangement, said blank being cut and scored to provide:

(a) a first minor side wall panel, a first major front side wall panel, a second minor side wall panel, and a second major rear side wall panel foldably joined to each other along parallel fold lines;

(b) pairs of opposed upper and lower and inner outer closure flaps foldably joined to upper and lower ends of said minor and major side wall panels, respectively;

(c) each of said upper inner closure flaps including:

(i) a first section foldably joined, on a first fold line, to an outer end edge of a related one of said minor side wall panels;

(ii) a second section foldably joined, on a second fold line, to an outer edge of said first section;

(iii) a third section foldably joined, on a third fold line, to an outer edge of said second section, and presenting a lock tab receiving opening located adjacent said second section;

(e) upper end portions of said front side wall panel and said minor side wall panels being detachable from remaining portions to form, with said upper closure flaps when a carton is erected from said blank, a cover hinged to an upper edge of said rear side wall panel.

15. A carton blank according to claim 14, wherein each of said lock tab forming openings is formed by a slit in said vertical section that is spaced a distance short from and extends parallel to said third fold line.

16. A carton blank according to claim 14, wherein each of said lock tab receiving openings is a hole that is defined by parallel first edges, located on both sides of said third fold line, and second edges connecting corresponding ends of said first cut lines to each other.

17. A carton blank according to claim 14, wherein each of said lock tab receiving openings is located adjacent one end of said third fold line.

18. A carton blank according to claim 14, wherein each of said lock tab receiving openings is located intermediate and is spaced from opposite ends of said third fold line.

19. A carton blank according to claim 14, including a detachable tear strip extending across portions of said minor side wall panels and said major front side wall panel, and wherein said minor side wall panels have weakened lines of tear extending down and forwardly from upper edges of said minor side wall panels to adjacent ends of said tear strip, to separate an upper portion of said carton from a lower portion thereof and thereby form a hinged cover joined to an upper edge of said major rear side wall panel when said carton is erected from said blank.

20. A unitary blank of foldable sheet material, such as paperboard, for use in making a liner for a carton with an integral, reclosable, hinged, flip top cover having a positive side lock arrangement, said blank being cut and scored to provide:

(a) a first glue flap, a first minor panel, a major panel, a second minor panel, and a second glue flap foldably joined to each other along parallel first fold lines;

(b) each of said minor panels having, foldably joined to an upper edge thereof along a second fold lines extending normal to said first mentioned fold line, a relatively narrow lock panel;

(c) said blank having formed therein, at said second fold lines, carton cover lock tab forming openings.

* * * * *